US010548347B2

(12) United States Patent
Playford

(10) Patent No.: US 10,548,347 B2
(45) Date of Patent: Feb. 4, 2020

(54) CONTAINER FOR SMOKELESS TOBACCO PRODUCTS

(71) Applicant: American Snuff Company, LLC, Memphis, TN (US)

(72) Inventor: Richard Stephen Playford, Memphis, TN (US)

(73) Assignee: American Snuff Company, LLC, Memphis, TN (US)

( * ) Notice: Subject to any disclaimer, the term of this patent is extended or adjusted under 35 U.S.C. 154(b) by 0 days.

(21) Appl. No.: 15/904,029

(22) Filed: Feb. 23, 2018

(65) Prior Publication Data

US 2019/0261681 A1 Aug. 29, 2019

(51) Int. Cl.

*A24F 23/00* (2006.01)
*A24F 23/02* (2006.01)
*A24F 15/00* (2006.01)

(52) U.S. Cl.

CPC ..... *A24F 23/00* (2013.01); *A24F 23/02* (2013.01); *A24F 15/00* (2013.01)

(58) Field of Classification Search

CPC ..... A24F 23/02; A24F 23/00; A24F 15/00; A24F 15/02; A24F 15/12
USPC ..... 206/236, 459.5, 242, 264
See application file for complete search history.

(56) References Cited

U.S. PATENT DOCUMENTS 1,376,586 A 5/1921 Schwartz
3,368,567 A 2/1968 Speer
3,580,481 A * 5/1971 Koboldt ..... B65D 17/462 229/201
3,826,421 A * 7/1974 Morse ..... B65D 5/5445 206/438
3,951,333 A * 4/1976 Forbes, Jr. ..... B65D 5/5425 229/207
4,098,421 A 7/1978 Foster
4,190,170 A 2/1980 Boyd
4,513,756 A 4/1985 Pittman et al.
4,606,357 A 8/1986 Dusek et al.
4,624,269 A 11/1986 Story et al.
4,646,933 A * 3/1987 Jurczenia ..... B65D 51/1666 220/366.1

(Continued)

FOREIGN PATENT DOCUMENTS

WO WO 97/01495 1/1997
WO WO 2006/034450 3/2006

(Continued)

*Primary Examiner* — Steven A. Reynolds
(74) *Attorney, Agent, or Firm* — Womble Bond Dickinson (US) LLP

(57) ABSTRACT

A container adapted for storing a product includes a body having a bottom wall and a side wall. The bottom wall and the side wall define an internal storage compartment adapted for storage of a product. The side wall has an outer peripheral surface. A cover is configured to be removably engaged with the body. The cover includes a top wall and a peripheral flange having an inner surface. The inner surface is configured to interact with the base when the cover is received over the outer peripheral surface of the side wall so as to form an interface. A label is configured to substantially cover the interface, wherein the label includes a tear thread positioned between an outer surface of the container and a rear surface of the label and located substantially at the interface of the cover and the body.

22 Claims, 7 Drawing Sheets

(56) References Cited

U.S. PATENT DOCUMENTS

| | | | | |
|---|---|---|---|---|
| 4,802,498 | A | 2/1989 | Ogren | |
| 4,821,749 | A | 4/1989 | Toft et al. | |
| 4,975,270 | A | 12/1990 | Kehoe | |
| 5,167,244 | A | 12/1992 | Kjerstad | |
| 5,387,416 | A | 2/1995 | White et al. | |
| 6,668,839 | B2 | 12/2003 | Williams | |
| 7,810,507 | B2 | 10/2010 | Dube et al. | |
| 7,819,124 | B2 | 10/2010 | Strickland et al. | |
| 7,861,728 | B2 | 1/2011 | Holton, Jr. et al. | |
| 8,118,161 | B2 | 2/2012 | Guerrera et al. | |
| 8,393,465 | B2 * | 3/2013 | Clark | A24F 23/00 206/242 |
| D688,938 | S | 9/2013 | Bailey et al. | |
| D689,772 | S | 9/2013 | Jones et al. | |
| 8,540,113 | B2 | 9/2013 | Bailey | |
| D709,758 | S | 7/2014 | Burdock-Latter et al. | |
| 8,910,781 | B2 | 12/2014 | Pipes et al. | |
| 8,944,248 | B2 | 2/2015 | Jones et al. | |
| D727,723 | S | 4/2015 | Pipes et al. | |
| D727,724 | S | 4/2015 | Pipes et al. | |
| 9,072,320 | B2 | 7/2015 | Coatney et al. | |
| 9,108,784 | B2 | 8/2015 | Pipes et al. | |
| D740,018 | S | 10/2015 | Zhang et al. | |
| D747,878 | S | 1/2016 | Mach et al. | |
| D748,498 | S | 2/2016 | Pipes et al. | |
| D756,223 | S | 5/2016 | Pipes et al. | |
| 9,346,594 | B2 | 5/2016 | Pipes et al. | |
| 9,445,631 | B1 | 9/2016 | Patel et al. | |
| 9,493,291 | B2 | 11/2016 | Pipes et al. | |
| 9,717,272 | B2 | 8/2017 | Patel et al. | |
| 9,738,049 | B2 | 8/2017 | Pipes et al. | |
| 9,790,020 | B1 | 10/2017 | Sebastian et al. | |
| 9,936,729 | B2 | 4/2018 | Garcia et al. | |
| 9,968,129 | B2 | 5/2018 | Sebastian et al. | |
| 9,968,130 | B2 * | 5/2018 | Potter | B65D 81/26 |
| 2004/0217024 | A1 | 11/2004 | Arnarp et al. | |
| 2005/0244521 | A1 | 11/2005 | Strickland et al. | |
| 2006/0118589 | A1 | 6/2006 | Arnarp et al. | |
| 2006/0191548 | A1 | 8/2006 | Strickland et al. | |
| 2007/0130811 | A1 * | 6/2007 | Shevelev | B65D 55/0818 40/312 |
| 2008/0029116 | A1 | 2/2008 | Robinson et al. | |
| 2009/0014450 | A1 | 1/2009 | Bjorkholm | |
| 2009/0230003 | A1 * | 9/2009 | Thiellier | A24F 23/00 206/247 |
| 2010/0065076 | A1 | 3/2010 | Bergstrom et al. | |
| 2010/0065077 | A1 | 3/2010 | Lofgreen-Ohrn et al. | |
| 2012/0193265 | A1 * | 8/2012 | Patel | A24F 23/00 206/524.6 |
| 2013/0292279 | A1 | 11/2013 | Bengtsson et al. | |
| 2014/0262903 | A1 | 9/2014 | Mitten et al. | |
| 2015/0274401 | A1 | 10/2015 | Mabe et al. | |
| 2015/0320113 | A1 | 11/2015 | Stebbins et al. | |
| 2015/0321787 | A1 | 11/2015 | Stebbins et al. | |
| 2016/0101891 | A1 | 4/2016 | Bailey et al. | |
| 2016/0106149 | A1 | 4/2016 | Potter et al. | |
| 2016/0349543 | A1 | 12/2016 | Rogers | |
| 2016/0360783 | A1 | 12/2016 | Patel et al. | |
| 2017/0100308 | A1 | 4/2017 | Lampe et al. | |
| 2017/0332693 | A1 | 11/2017 | Benford | |
| 2018/0174500 | A1 | 6/2018 | Sebastian et al. | |
| 2018/0184709 | A1 | 7/2018 | Garcia et al. | |
| 2018/0220702 | A1 | 8/2018 | Sebastian et al. | |
| 2018/0220703 | A1 | 8/2018 | Potter et al. | |
| 2018/0263859 | A1 | 9/2018 | Lampe et al. | |

FOREIGN PATENT DOCUMENTS

| | | |
|---|---|---|
| WO | WO 2007/017761 | 2/2007 |
| WO | WO 2007/067953 | 6/2007 |

* cited by examiner

CONTAINER FOR SMOKELESS TOBACCO PRODUCTS

FIELD OF THE DISCLOSURE

The present disclosure relates to containers and methods of use thereof. More particularly, the disclosure relates to packaging and opening mechanisms for containers for tobacco products.

BACKGROUND OF THE DISCLOSURE

Various types of containers for dispensing solid objects, particularly solid products intended for human consumption, are known in the art. Such containers are often characterized by a hand-held size that can be easily stored and transported. Example consumable products that are often packaged in such containers include a wide variety of consumer products, including smokeless tobacco-related products.

Tobacco may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; and U.S. Pat. No. 7,861,728 to Holton, Jr. et al.; U.S. Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; and 2010/0291245 to Gao et al.; PCT Pub. Nos. WO 04/095959 to Arnarp et al.; and WO 10/132444 to Atchley; each of which is incorporated herein by reference.

Representative smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

Representative types of snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. are marketed under the trade names such as CAMEL Snus Frost, CAMEL Snus Original and CAMEL Snus Spice by R. J. Reynolds Tobacco Company.

Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus does not require expectoration by the user.

Snus products have been packaged in tins, "pucks" or "pots" that are manufactured from metal or plastic such as those disclosed in U.S. Pat. No. 4,098,421 to Foster and U.S. Pat. No. 4,190,170 to Boyd, and U.S. Patent Pub. Nos. 2010/0065076 to Bergstrom et al.; and 2010/0065077 to Lofgreen-Ohrn et al.; each of which is incorporated by reference herein.

A desirable feature for certain containers is the protection of the product from environmental effects, particularly those effects that may degrade the product stored in the container. For example, in humid environments, moisture may invade the storage space housing the product, thereby damaging the product or otherwise rendering the product unusable. In other instances, venting within the enclosure formed by the container may be needed for properly storing a product.

It would thus be desirable to provide an improved packaging for smokeless tobacco products and the like, wherein the packaging is aesthetically pleasing and provides various advantageous features, such as protection from environmental effects by venting the container.

BRIEF SUMMARY OF THE DISCLOSURE

The present disclosure provides a container that, in certain embodiments, includes a label adhered to an exterior surface of the container that can prevent tampering with the product before purchase and a tear-open thread affixed between the label and the exterior surface of the container that can facilitate opening of the container by a user. In some embodiments, the container can be provided in a convenient handheld size. The type and form of the product to be stored within the container can vary. In certain embodiments, the container can be used to store smokeless tobacco products.

In one embodiment, the container of the disclosure comprises a body having a bottom wall and a side wall. The bottom wall and the side wall define an internal storage compartment adapted for storage of a product. The side wall has an outer peripheral surface. The container can further comprise a cover configured to be removably engaged with the body, the cover having a top wall and a peripheral flange having an inner surface, the inner surface being configured to interact with the body when the cover is received over the outer peripheral surface of the side wall so as to form an interface. The container can also comprise a label configured to substantially cover at least a portion of the interface, wherein the label comprises a tear thread positioned between an outer surface of the container and a rear surface of the label. In some embodiments, the label can substantially cover the entire interface of the container.

In various embodiments, the body is comprised of a polymeric material, and the cover is comprised of a metallic material. In some embodiments, the side wall of the body comprises a neck region located at an upper portion of the side wall, wherein the neck region has a reduced diameter as compared to a diameter of a lower portion of the side wall, and wherein the inner surface of the cover is configured to interact with the neck region. In certain embodiments, the container further comprises a circumferential rib structure integrally formed with the polymeric body about the outer peripheral surface of the side wall and extending radially outwardly therefrom, the rib structure comprising a plurality of rib segments extending circumferentially about the outer peripheral surface of the side wall, the rib segments being spaced apart so as to form vent channels therebetween. In various embodiments, at the interface, the side wall defines a lip and the peripheral flange of the cover abuts the lip.

In various embodiments of the containers described herein, at least a portion of the rear surface of the label comprises an adhesive material useful for adhering the label to the exterior surface of the container. In certain embodiments, the entire rear surface of the label comprises an adhesive layer. In various embodiments, the label is applied to the container such that the tear thread is positioned such that it substantially aligns with the interface between the cover and the body.

In some embodiments, the label has a length, and wherein the tear thread extends the entire length of the label. In certain embodiments, the tear thread extends along a portion of the length of the label. In various embodiments, the tear thread comprises a portion that extends beyond the length of the label such that the portion is available to a user to grasp after the label has been adhered to the exterior surface of the container.

In various embodiments, the internal storage compartment comprises a plurality of products. The product can be, for example, one of smoking products and smokeless tobacco products.

A method for assembling a packaged product assembly is also provided herein. In various embodiments, the method can comprise providing a body having a bottom wall and a side wall, the bottom wall and the side wall defining an internal storage compartment adapted for storage of a product, the side wall having an outer peripheral surface; providing a cover, wherein the cover configured to be removably engaged with the body, the cover having a top wall and a peripheral flange having an inner surface, the inner surface being configured to interact with the body when the cover is received over the outer peripheral surface of the side wall so as to form an interface; and coupling the cover to the body. The method can further include providing the product and inserting the product into the internal storage compartment. Furthermore, the method can include sealing or at least partially sealing the container with a label or wrapper of a pervious or impervious material, wherein the label is configured to substantially cover at least a portion of the interface, and wherein the label comprises a tear thread adhered to a rear surface of the label.

These and other features, aspects, and advantages of the disclosure will be apparent from a reading of the following detailed description together with the accompanying drawings, which are briefly described below.

BRIEF DESCRIPTION OF THE DRAWINGS

Figure 1:
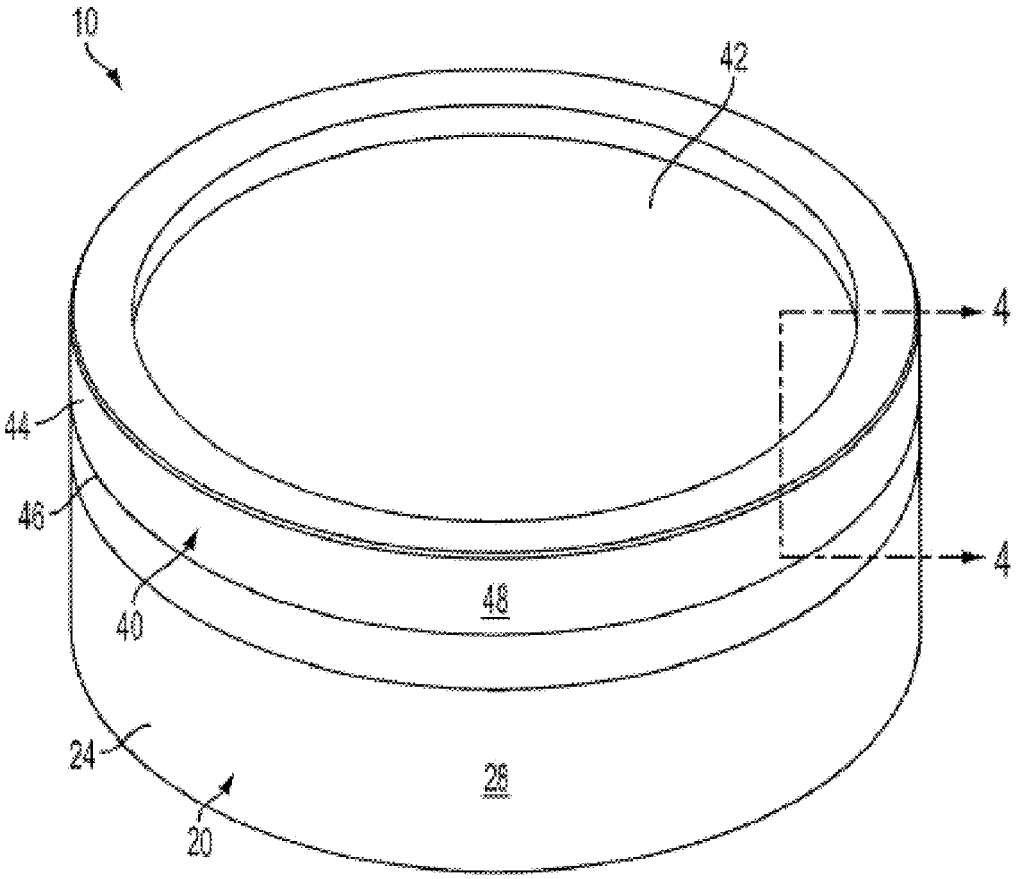
Figure 2:
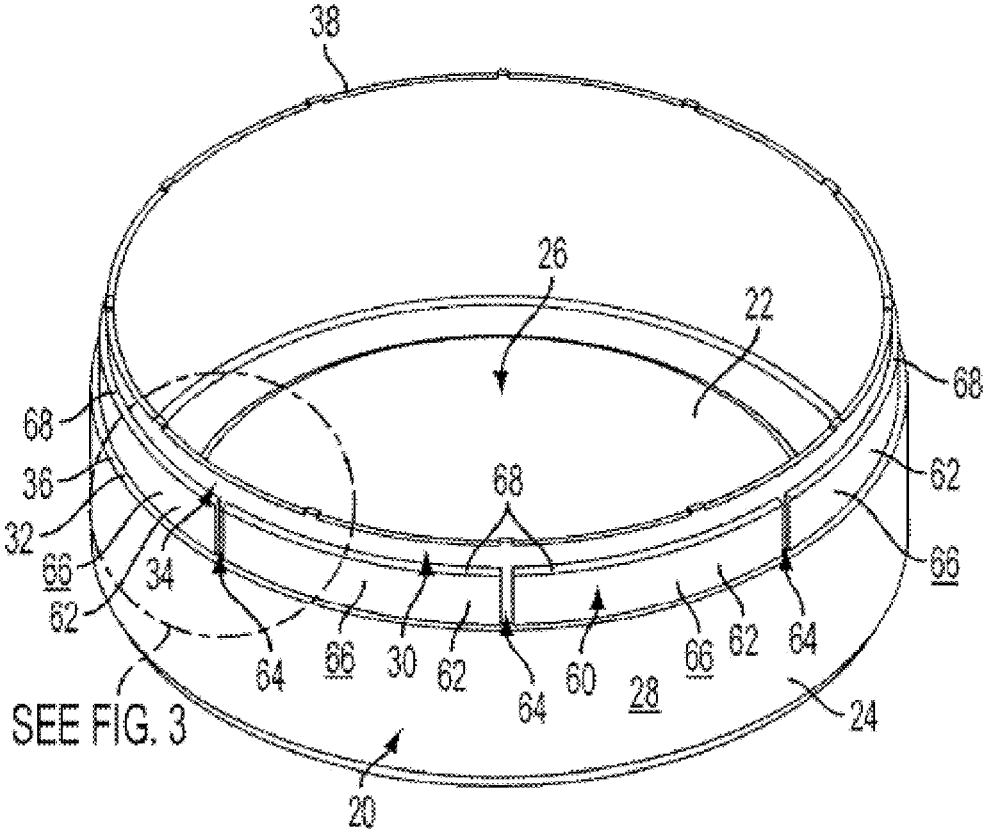
Figure 3:
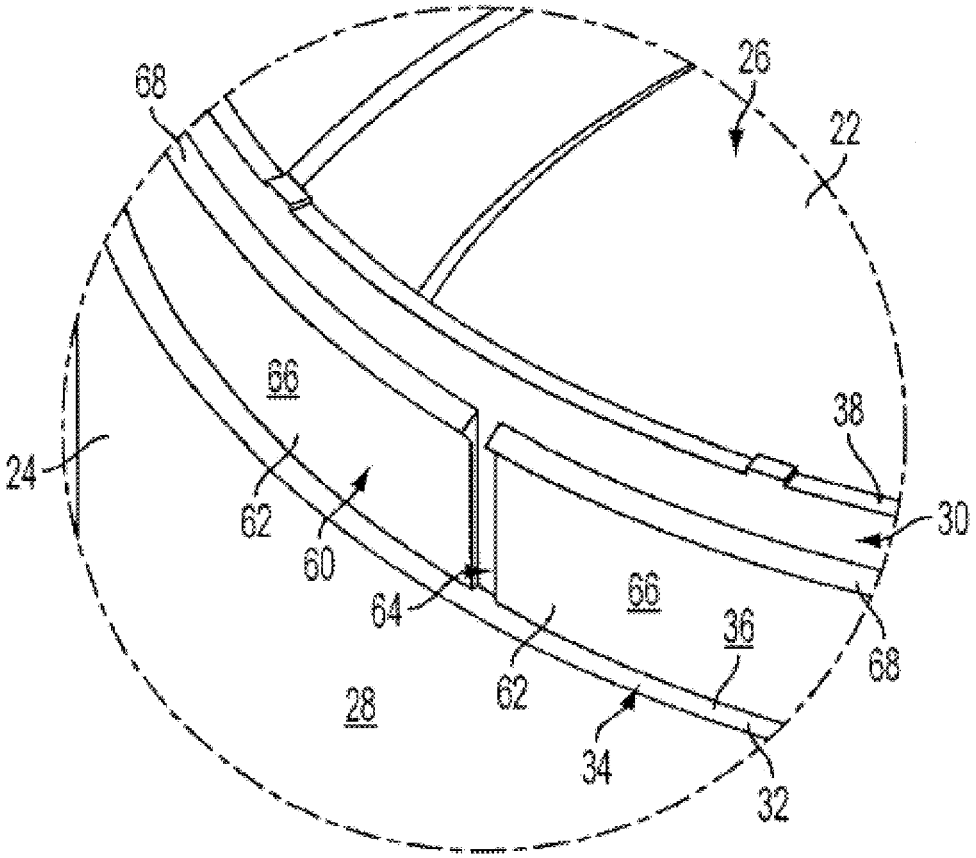
Figure 4:
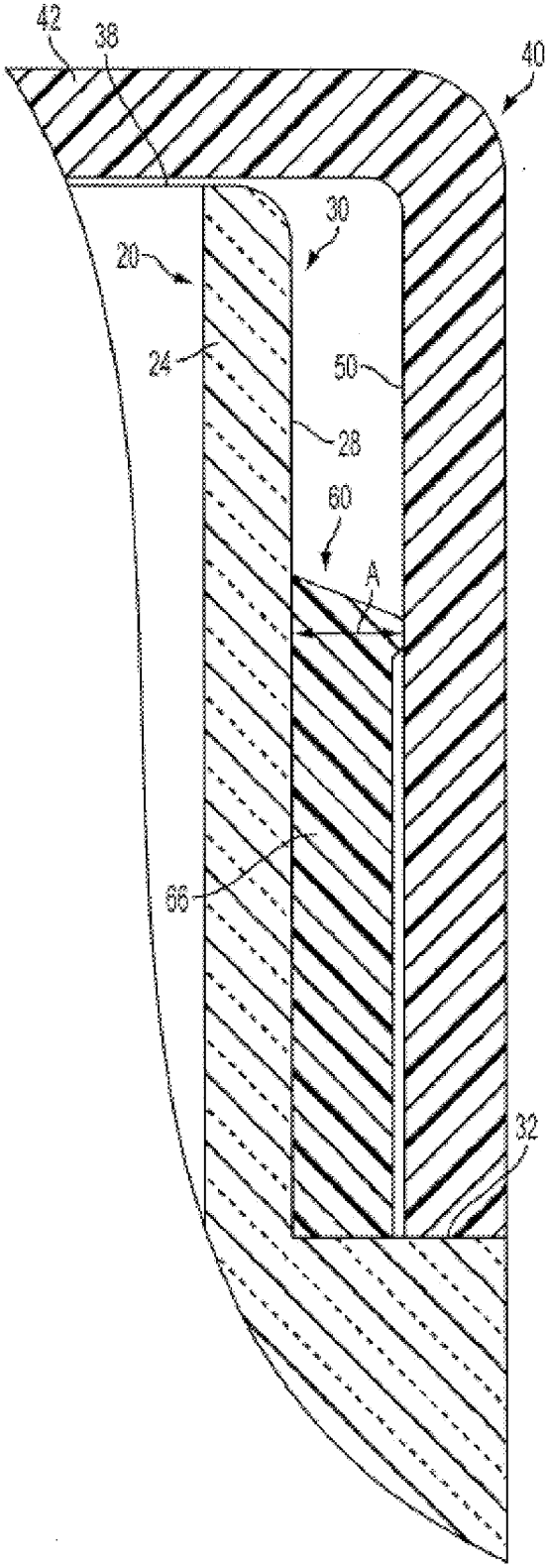
Figure 5:
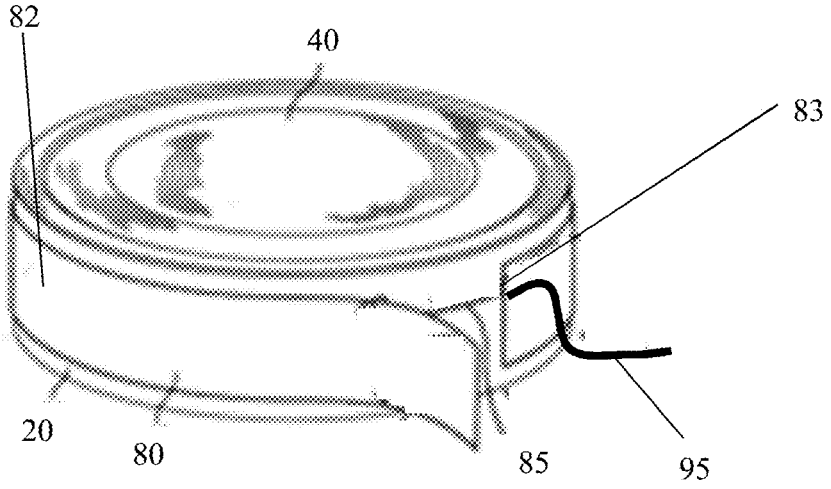
Figure 6:
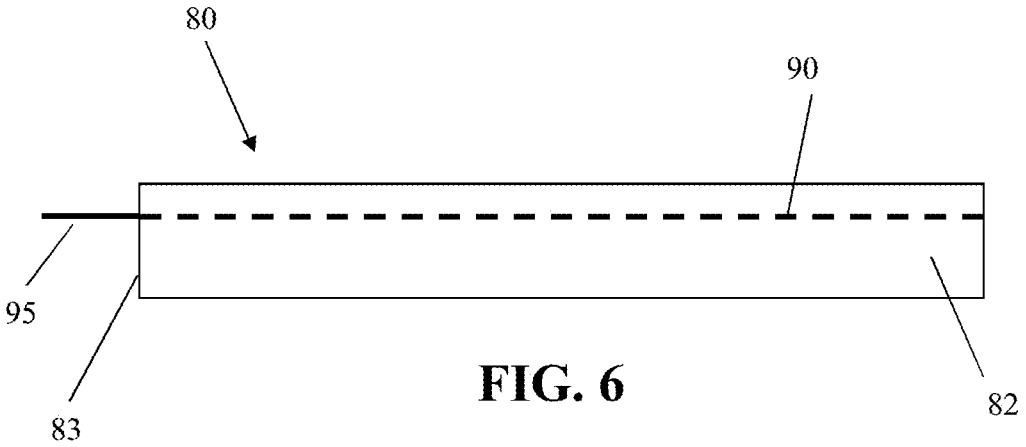
Figure 7A:
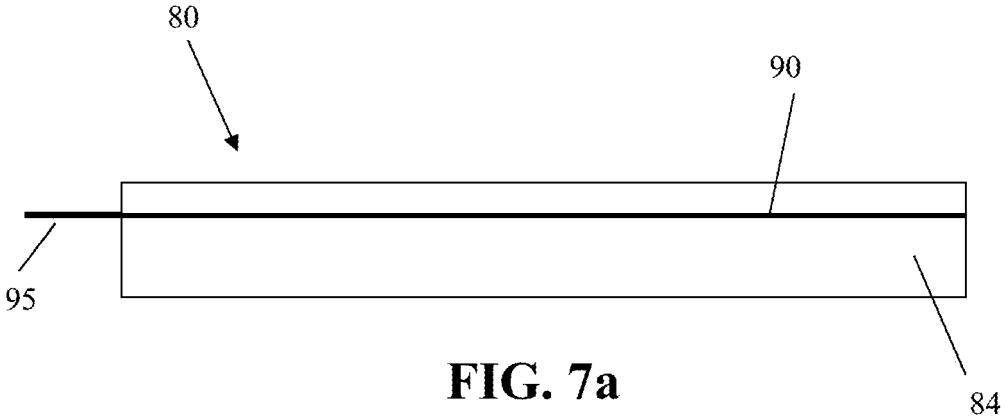
Figure 7B:
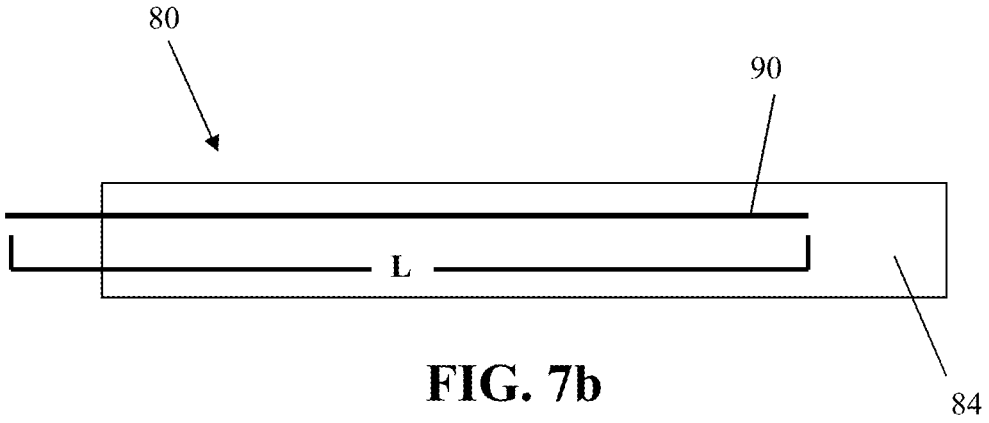
Figure 8:
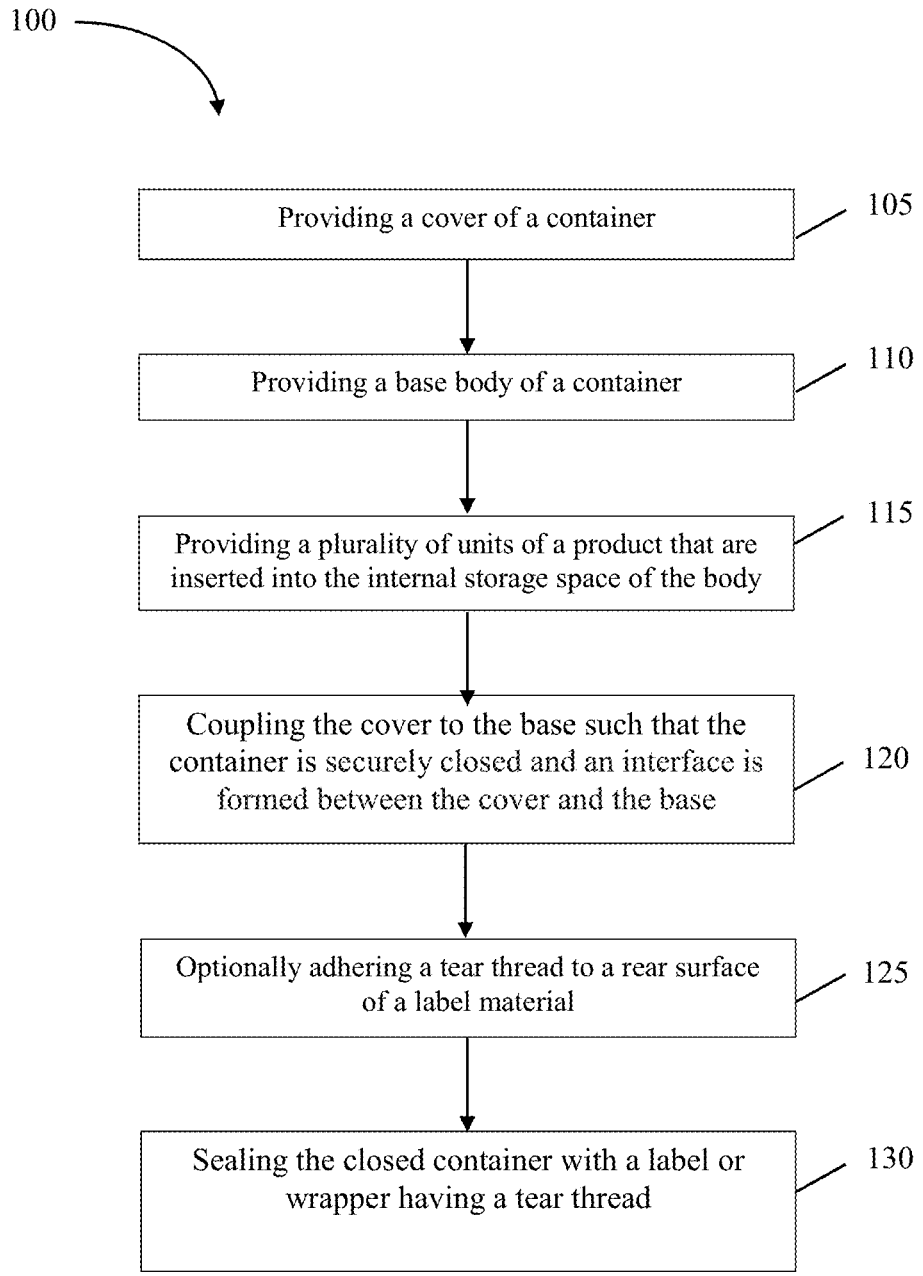

Having thus described the disclosure in general terms, reference will now be made to the accompanying drawings, which are not necessarily drawn to scale, and wherein:

FIG. 1 is a perspective view of a container embodiment of the present disclosure;

FIG. 2 is a perspective view of a body of a container embodiment according to the present disclosure;

FIG. 3 is a magnified view of a portion of the body of FIG. 2;

FIG. 4 is a magnified sectional view on the line 4-4 of FIG. 1;

FIG. 5 illustrates a perspective view of a container embodiment of the present disclosure in a closed position with a label adhered to an exterior surface of the container;

FIG. 6 illustrates a front perspective view of a label of the present disclosure;

FIGS. 7*a* and 7*b* illustrate a rear perspective view of a label of the present disclosure; and FIG. 8 is a flow diagram showing an example process for assembling products described herein.

DETAILED DESCRIPTION OF THE DISCLOSURE

The present disclosure now will be described more fully hereinafter with reference to certain preferred aspects. These aspects are provided so that this disclosure will be thorough and complete, and will fully convey the scope of the disclosure to those skilled in the art. Indeed, the disclosure may be embodied in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

In various embodiments of the present invention, a container having an exterior label or film helping to seal the container is provided, wherein the exterior label or film includes or is adhered to a tear-open thread or weakened tear strip which facilitates opening and/or removal of the label or film upon a first opening of the container. The container embodiments described in the present application can be used to store any solid products, but are particularly well-suited for products designed for oral consumption. Example consumable products that are often packaged in such containers include a wide variety of consumer products, including tobacco products in smokeless form, as described in more detail below.

Example containers useful in the present invention are disclosed in U.S. Pat. Pub. No. 2012/0193265 to Patel et al., which is herein incorporated by reference. The shape of the outer surface of the containers of the disclosure can vary. Although the container embodiments illustrated in the drawings have certain contours, containers with other exterior surface designs could also be used. For example, the sides or edges of the containers of the disclosure could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the disclosure. However, in preferred embodiments, the containers of the disclosure can be described as having a cylindrical size suitable for handheld manipulation and operation. Example dimensions for such handheld cylindrical embodiments include diameters in the range of about 50 mm to about 100 mm, and more typically about 60 mm to about 80 mm. Example wall thicknesses include the range of about 0.5 mm to about 1.5 mm, and more typically about 0.8 mm to about 1.4 mm. Example depths for handheld container embodiments of the present disclosure range from about 5 mm to about 50 mm, more typically about 8 mm to about 30 mm, and most often about 15 mm to about 25 mm. An example general outward appearance of the container is that used for commercially available GRIZZLY and KODIAK products that are marketed by American Snuff Company, LLC.

The number of solid product units stored in the containers of the disclosure can also vary, depending on the size of the container and the size of the product units. Typically, the number of stored product units will vary from about 5 to about 100, more typically about 10 to about 50, and most often about 15 to about 30.

FIGS. 1-4 illustrate one container embodiment 10 in accordance with the present disclosure. The container 10 may be formed by an open-ended body 20 and a cover 40. The body 20 has a bottom wall 22 (see FIG. 2), which, in some instances, may be substantially planar, and a side wall 24 depending from the bottom wall 22 which, in some instances, may be cylindrical as shown. The side wall 24 defines a peripheral portion of the container 10 such that the side wall 24 includes an outer peripheral surface 28. The bottom wall 22 and the side wall 24 cooperate to define an internal storage compartment 26 for storage of a plurality of units of a product. In some instances, an upper portion 30 of the side wall 24 may define a lip 32 in such a manner that the upper portion 30 the side wall has a neck region 34 of reduced diameter (as compared to the diameter of the remainder of the outer surface of the side wall). Note that the location of the lip 32 along the side wall 24 of the body 20 can vary without departing from the present disclosure, meaning that distance between the lip 32 and the top edge 38 of the body 20 is not critical to the present disclosure.

The cover 40 may be provided for enclosing the units of product within the internal storage compartment 26. In this regard, the cover 40 is typically removably secured to the body 20 by a snap-fit or an interference fit. As shown in FIG. 1, the cover 40 has a top wall 42, which, in some instances, may be substantially planar, and a peripheral flange 44 depending from the top wall 42 which, in some instances, may be cylindrical. The peripheral flange 44 of the cover 40 is received over the side wall 24 of the body 20 so as to form an enclosure therebetween. The peripheral flange 44 includes a substantially flat or smooth inner surface 50 (FIG. 4). That is, the inner surface 50 typically does not include any protrusions, projections, ribs, or the like for interacting with the outer peripheral surface 28 of the side wall 24 of the body 20. In this regard, the inner surface 50 is substantially smooth and continuous about the cylindrical configuration thereof. In some instances where the lip 32 is provided on the body 20, at least a portion of an edge 46 of the peripheral flange 44 may interact with a surface 36 of the lip 32 to form a stop when the cover 40 is received upon the body 20. In other words, in instances in which the edge 46 interacts with the lip 32, at least a portion of the edge 46 of the cover 40 will abut a portion of the surface 36 when the cover 40 is fully seated upon the body. The edge 46 and surface 36 are typically planar, but it will be appreciated that one or both of the edge 46 and surface 36 may comprise a non-planar profile in some embodiments. For example, the edge 46 and surface 32 may comprise corresponding profiled engagement surfaces in some embodiments.

A cylindrical outer surface 48 of the cover 40 will typically have the same approximate size or diameter as the side wall 24 of the body 20 such that the cover and body form a smooth exterior surface when the cover is placed over the neck region 34 of the side wall and fully seated upon the body. Hence, the container 10 may be compact and flat so as to be suitable for storage and transportation by a user.

The material of construction of the container 10 can vary. Example materials include metal, wood, and synthetic plastic materials. Polymeric materials that can be extruded and/or molded into desired shapes are typically utilized, such as polyethylene, polystyrene, polyamide, and the like. In some embodiments, the body 20 is formed from a polymeric material, while the cover 40 is formed from a metallic material such as, for example, aluminum or tinplate. Such a configuration is advantageous in that it provides an aesthetically appealing appearance by using a metallic cover 40 (which is typically stamped), while also allowing the body to be less expensively produced using, for example, an injection molding process. Example covers formed from metallic materials are those used for commercially available CAMEL Snuff, GRIZZLY and KODIAK products that are marketed by American Snuff Company, LLC. Example bodies are those that incorporate polymeric materials such as those types of materials used for the same products.

In various embodiments, the container can include a means for securing or sealing the lid to the base of the container. See, e.g., U.S. Pat. Pub. No. 2014/0197054 to Pipes et al, which is herein incorporated by reference. For example, in certain embodiments, the container can include a rib structure (as described in U.S. Pat. Pub. No. 2012/0193265 to Patel et al., which is herein incorporated by reference) applied to the body 20 e.g., via plastic injection molding). As particularly shown in FIGS. 2 and 3, projecting from the outer peripheral surface 28 of the body 20 (and, when provided, the neck region 34) is a circumferential rib structure 60 configured to form a seal with the cover 40. In some aspects, the rib structure may be integrally formed with the side wall 24 of the body 20, such as, for example, when the body 20 is formed by a plastic injection molding process. In other instances, the rib structure 60 may be a separate and discrete component secured or otherwise affixed to the side wall 24 with appropriate mechanical fasteners or adhesive (e.g., an epoxy adhesive). According to some aspects of the present disclosure, the rib structure 60 may be formed by a plurality of rib segments 62 arranged in spaced relation around the periphery of the side wall 24 of the body 20 (e.g., positioned circumferentially about the side wall 24 of the body 20 where the container body is cylindrical). Any number of rib segments 62 may be provided in containers useful in the present invention (e.g., about 2 to about 20 rib segments or about 5 to about 15 rib segments), although a preferred embodiment includes twelve such rib segments. Each rib segment 62 is separated from the next adjacent rib segment 62 by a vent channel 64. Each rib segment 62 may include a rib wall 66 and a rib projection 68. As shown in FIG. 4, the rib projections 68 interact with the peripheral flange 44 of the cover 40 in an interference fit when the cover is positioned over the side wall 24 of the body 20, so as to form a seal therebetween. In this regard, the rib projections 68 force the peripheral flange 44 outward of the outer peripheral surface 28 to form a tight fit at the interface when the cover 40 is engaged with the body 20.

In various embodiments, the containers can be sealed with a circumferential label or wrapper of a pervious or impervious material. The label or wrapping material useful in accordance with the present disclosure can vary. In some embodiments, labels provided herein can comprise a paper material, a polymer material (e.g., a web made of one or more polymer components), and combinations thereof. Typically, the selection of the packaging label or wrapper is dependent upon factors such as aesthetics, desired barrier properties (e.g., so as to provide protection from exposure to oxygen, or so as to provide protection from loss of moisture), or the like.

A label 80 provided herein can have a front surface 82 and a rear surface 84. In some embodiments, a front surface of the label can include printing and/or imprinting to decorate the container and/or provide product identifying information. For example, a front surface of the label provided herein can include printed characters, symbols, pictures, designs, colors, or other indicia. In some embodiments, the product identifying information can identify a product brand, a company name, a corporate logo, a corporate brand, trademarks, tradenames, a marketing message, product strength, dosage information, active ingredient, ingredient lists and amounts, product manufacture date, product expiration date, product flavor, product pharmaceutical release profile, weight, product code (e.g., batch code), other product differentiating markings, and combinations thereof. As used herein, "product strength" refers to information that gives the user an indication of the amount of active ingredient within the pouch.

The product identifying information can be presented in such a way that a user of the product can discern the identifying information by visually inspecting the product and thereby differentiate or identify certain products. The product identifying information can be, for example, printed or dyed on the outer surface of the label, imprinted (e.g., embossed, debossed, or otherwise pressed) on the outer surface of the label, deposited on the outer surface of the label, adhered to the outer surface of the label, positioned in intimate contact with the outer surface of the label, woven or sewn onto the label, or otherwise attached to the outer surface of the label. In some embodiments, product identifying information can be provided by a selection of material (e.g., a material that is different in composition, different in color, different in texture, different in thickness, or different in some other defined property). In various embodiments, the product identifying information can be applied through heat and pressure. In some embodiments, product identifying information can be provided during application of the label as the container is manufactured. In various embodiments, product identifying information can be provided in a secondary process separate from a label application process. Product identifying information can be provided at any point during a container manufacturing process.

In some embodiments, the rear surface 84 of label 80 can include an adhesive layer which allows the label to be adhered to the surface of another object. The entire rear surface can include an adhesive layer. Alternatively, only a portion of the rear surface or designated locations on the rear surface of the label can comprise an adhesive layer, coating, or material applied thereto.

As illustrated in FIG. 5, for example, the rear surface 84 of the label can be adhesively bonded to the outer peripheral surface 28 of the body 20 and to cylindrical outer surface 48 of the cover 40, such that the label covers the interface 85 between the container body 20 and the container cover 40 of a container in a closed position. The label 80 can contribute to sealing of the container. In some embodiments, a label provided herein can provide tamper evidence by indicating when a container has been opened. In this regard, if the label is torn or dislodged, such as through use of the tear thread provided in herein in various embodiments, it may be evidence that the container may have been opened and/or otherwise tampered with.

As illustrated in FIGS. 6 and 7, for example, a tear thread 90 can be adhered to the rear surface 84 of the label 80. As such, when the label is adhered to the exterior surface of the container, the tear thread will be positioned between the exterior surface of the container and the rear surface of the label. In various embodiments, there can be an absence of adhesive of the label in a region where the tear thread is aligned with the label such that the tear thread could enable tearing of the label up to or down to an adhesive line (e.g., above and/or below the interface) so as to enable opening of the container at the interface.

In preferred embodiments, the tear thread 90 can be positioned on the rear surface of the label such that, when the label is applied to the container, the tear thread approximately aligns with the interface 85 between the container body 20 and the container cover 40 of a container in a closed position. In some embodiments, the tear thread can be aligned slightly above or slightly below the interface 85.

As used herein, the term "tear thread" refers to one or more lengths of a continuous fiber, string, thread, yarn, flexible metallic strip, strip with a metallic core and at least partially surrounded by a fibrous and/or polymer material, and the like. In various embodiments, the tear thread can comprise a fibrous material, an extruded polymer material (e.g., nylon, fluorocarbon, etc.) comprising one or more polymer components, and combinations thereof. In some embodiments, a plurality of continuous fibers can be bundled, braided, and/or woven together to form a tear thread. The tear thread may have any of a variety of cross-sectional profiles. For example, the tear thread can have a rounded profile, polygonal profile, substantially flat (e.g., ribbon-shaped) profile, irregular shaped profile, triangular profile, etc. In some embodiments, the tear thread can have a serrated profile over at least a portion of the tear thread and/or a coating added to at least a portion of the tear thread that can facilitate tearing/cutting the label.

In various embodiments, the tear thread can have a length L such that when applied, it extends along at least a portion of the periphery of the container. In various embodiments, the tear thread can extend along the entire length of the label (see, e.g., FIG. 7*a*). In some embodiments, the tear thread can extend only along a portion of the length of the label (see, e.g. FIG. 7*b*). The tear thread can be used to cut through the label and open the container without the use of a fingernail, knife, or other device useful for cutting and/or peeling off the label. In certain embodiments, the label and tear thread can be figured such that multiple independent lengths of a label can be individually torn. For example, the label can include one or more perforated or fibrillated portions extending along a width of the label (e.g., perpendicular to the tear thread) such that sections of the label can be independently torn by one or more tear threads.

In various embodiments, a portion 95 of tear thread 90 can extend beyond the length of label 80. As such, when label 80 is adhered to a container, portion 95 of tear thread 90 will not be positioned between the exterior surface of the container and the rear surface of the label, but will instead extend loosely from a side edge 83 of label 80. A user can thereby easily grasp the tear thread via the loosely extended portion 95 of tear thread 90, and by pulling on the extended portion 95, can easily rip through the label which surrounds at least a portion of the exterior surface of the container. As described above, in some embodiments, the tear thread 90 can be positioned such that it approximately aligns with the interface 85. Accordingly, when a user pulls on the tear thread, the tear thread can split the label along the interface between the body and cover of the container. After accessing the contents of the container, the user can again close the container and any product identifying information present on the exterior surface of the label can still be reasonably visible.

Example tobacco products which can be housed in the containers described herein include pelletized tobacco products (e.g., compressed or molded pellets produced from powdered or processed tobacco, such as those formed into the general shape of a coin, cylinder, bean, pellet, sphere, orb, strip, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like. Further, example tobacco products include tobacco formulations in a loose form such as, for example, a moist snuff product. Example loose form tobacco used with the containers of the present disclosure may include tobacco formulations associated with, for example, commercially available GRIZZLY moist tobacco products and KODIAK moist tobacco products that are marketed by American Snuff Company, LLC.

Example smokeless tobacco compositions that can be packaged in the containers of the present disclosure are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. Pat. No. 7,810,507 to Dube et al.; U.S. Pat. No. 7,819,124 to Strickland et al.; U.S. Patent Pub. Nos. 2005/0244521 to Strickland et al.; 2006/0191548 to Strickland et al.; and 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in U.S. Patent Pub. Nos. 2004/0217024 and 2006/0118589 to Arnarp et al.; and 2009/0014450 to Bjorkholm; and PCT Pub. Nos. WO 2006/034450 to Budd; WO 2007/017761 to Kutsch et al.; and WO 2007/067953 to Sheveley et al. All of the above-cited references are incorporated by reference herein in their entirety.

Smokeless tobacco compositions utilized as the product contained in the containers of the disclosure will often include such ingredients as tobacco (typically in particulate form), sweeteners, binders, colorants, pH adjusters, fillers, flavoring agents, disintegration aids, antioxidants, oral care additives, and preservatives. See, for example, U.S. Pat. No. 7,861,728 to Holton et al., which is incorporated by reference herein in its entirety.

The tobacco formulation can be contained within a container, such as a pouch or bag, such as is the type commonly used for the manufacture of snus types of products (e.g., a sealed, moisture permeable pouch that is sometimes referred to as a "portion"). A representative moisture permeable pouch can be composed of a "fleece" type of material. The tobacco formulation is in turn contained within a package, such as the containers disclosed in U.S. Pat. Pub. No. 2012/0193265 to Patel et al., which is herein incorporated by reference. The package is sealed tightly, and is composed of a suitable material, such that the atmospheric conditions within that sealed package are modified and/or controlled. That is, the sealed package can provide a good barrier that inhibits the passage of compositions such as moisture and oxygen therethrough. In addition, the atmosphere within the sealed package can be further modified by introducing a selected gaseous species (e.g., nitrogen, argon, or a mixture thereof) into the package prior to sealing or by drawing a vacuum therein (vacuum sealing). As such, the atmospheric conditions to which the tobacco composition is exposed are controlled during conditions of preparation, packing, storage and handling.

An example pouch may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other example pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material. Descriptions of various components of snus products and components thereof also are set forth in U.S. Pat. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Den, and U.S. Pat. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmBH. G.D SpA out of Italy also supplies tobacco pouching equipment. Snus pouches can be provided as individual pouches, or a plurality of pouches and can be connected or linked together (e.g., in an end-to-end manner) such that a single pouch or individual portion can be readily removed for use from a one-piece strand or matrix of pouches.

A method 100 for assembling a packaged product assembly is also provided. As illustrated in FIG. 8, the method can include providing a cover at operation 105. The method can also include providing a base body defining a storage compartment at operation 110. The base may comprise a bottom wall and one or more base sidewalls extending from the bottom wall to an upper lip defining a base opening. The method can additionally include providing a plurality of units of a product at operation 115. The units of the product can be inserted into the storage compartment of the body. The method may also include coupling the cover to the base at operation 120, such that the container is securely closed and an interface is formed between the cover and the base. Once the containers of the disclosure are filled with the desired product, the containers can be sealed with a circumferential label or wrapper of a pervious or impervious material at operation 130, wherein the label covers the interface between the cover and the base. It is noted that in some embodiments, an entire rear surface of the label material comprises an adhesive which adheres to the exterior surface of the container. In certain embodiments, only a portion of the rear surface of the label material comprises an adhesive which adheres to a portion of the exterior surface of the container that is covered by the label material. Before adhering the label to the container, a tear thread can optionally be adhered to a rear surface of the label at operation 125. In certain embodiments, a tear label material is provided that already has a tear thread adhered thereto and operation 125 is not necessary. In some embodiments, labels provided herein can be used with existing labeling equipment (e.g., labeling equipment standard for labeling smokeless tobacco containers).

Many modifications and other aspects of the disclosure set forth herein will come to mind to one skilled in the art to which the disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A container, comprising:

a body having a bottom wall and a side wall, the bottom wall and the side wall defining an internal storage compartment adapted for storage of a product, the side wall having an outer peripheral surface;

a cover configured to be removably engaged with the body, the cover having a top wall and a peripheral flange having an inner surface, the inner surface being configured to interact with the body when the cover is received over the outer peripheral surface of the side wall so as to form an interface;

a label configured to substantially cover at least a portion of the interface, wherein the label comprises a tear thread positioned between an outer surface of the container and a rear surface of the label;

wherein the rear surface of the label includes a region comprising an adhesive material and a region proximate to the tear thread that is free of adhesive material.

2. The container of claim 1, wherein the body is comprised of a polymeric material and the cover is comprised of a metallic material.

3. The container of claim 1, wherein the side wall comprises a neck region located at an upper portion of the side wall, wherein the neck region has a reduced diameter as compared to a diameter of a lower portion of the side wall, and wherein the inner surface of the cover is configured to interact with the neck region.

4. The container of claim 1, wherein the container further comprises a circumferential rib structure integrally formed with the body about the outer peripheral surface of the side wall and extending radially outwardly therefrom, the rib structure comprising a plurality of rib segments extending circumferentially about the outer peripheral surface of the side wall, the rib segments being spaced apart so as to form vent channels therebetween.

5. The container of claim 1, wherein at the interface, the side wall defines a lip and the peripheral flange of the cover abuts the lip.

6. The container of claim 1, wherein the tear thread is positioned such that it substantially aligns with the interface of the cover and the body.

7. The container of claim 1, wherein the label has a length, and wherein the tear thread extends the entire length of the label.

8. The container of claim 1, wherein the label has a length, and wherein the tear thread extends along a portion of the length.

9. The container of claim 1, wherein the label has a length, and wherein the tear thread comprises a portion that extends beyond the length of the label.

10. The container of claim 1, wherein the label substantially covers the entire interface.

11. The container of claim 1, wherein the internal storage compartment comprises a plurality of products.

12. The container of claim 11, wherein the product is one of smoking products and smokeless tobacco products.

13. A method for assembling a packaged product assembly comprising:

providing a body having a bottom wall and a side wall, the bottom wall and the side wall defining an internal storage compartment adapted for storage of a product, the side wall having an outer peripheral surface;

providing a cover, wherein the cover configured to be removably engaged with the body, the cover having a top wall and a peripheral flange having an inner surface, the inner surface being configured to interact with the body when the cover is received over the outer peripheral surface of the side wall so as to form an interface;

providing the product;

inserting the product into the internal storage compartment;

coupling the cover to the body;

sealing the container with a label or wrapper, wherein the label is configured to substantially cover at least a portion of the interface, and wherein the label comprises a tear thread positioned between an outer surface of the container and a rear surface of the label;

wherein the rear surface of the label includes a region comprising an adhesive material and a region proximate to the tear thread that is free of adhesive material.

14. The method of claim 13, wherein the body is comprised of a polymeric material, and wherein the cover is comprised of a metallic material.

15. The method of claim 13, wherein the tear thread is positioned such that it substantially aligns with the interface.

16. The method of claim 13, wherein the label has a length, and wherein the tear thread extends the entire length of the label.

17. The method of claim 13, wherein the label has a length, and wherein the tear thread extends along a portion of the length.

18. The method of claim 13, wherein the label has a length, and wherein the tear thread comprises a portion that extends beyond the length of the label.

19. The method of claim 13, wherein the label substantially covers the entire interface.

20. The method of claim 13, wherein the units of product is one of smoking products and smokeless tobacco products.

21. The method of claim 13, wherein at the interface, the side wall defines a lip and the peripheral flange of the cover abuts the lip.

22. The method of claim 13, wherein the circumferential label or wrapper is of a pervious or impervious material.

* * * * *